US007721381B2

(12) United States Patent
Michelson et al.

(10) Patent No.: US 7,721,381 B2
(45) **Date of Patent: *May 25, 2010**

(54) CLEANING PAD

(75) Inventors: Robert Michelson, Wayland, MA (US); Thomas Dunn, Leominster, MA (US)

(73) Assignee: Butler Home Products, LLC, Marlborough, MA (US)

( * ) Notice: Subject to any disclaimer, the term of this patent is extended or adjusted under 35 U.S.C. 154(b) by 130 days.

This patent is subject to a terminal disclaimer.

(21) Appl. No.: 11/725,466

(22) Filed: Mar. 19, 2007

(65) Prior Publication Data

US 2007/0256266 A1 Nov. 8, 2007

Related U.S. Application Data

(63) Continuation of application No. 10/639,752, filed on Aug. 12, 2003, now Pat. No. 7,191,486.

(51) Int. Cl.
*A47L 13/10* (2006.01)
*A47L 13/20* (2006.01)

(52) U.S. Cl. ..... 15/228; 15/231

(58) Field of Classification Search ..... 15/228, 15/231, 208, 209.1, 210.1
See application file for complete search history.

(56) References Cited

U.S. PATENT DOCUMENTS

| | | | | |
|---|---|---|---|---|
| D121,357 | S | 7/1940 | Lubarsky et al. | |
| 3,104,998 | A | 9/1963 | Gelpke | |
| 3,681,184 | A | 8/1972 | Kalwaites | |
| 3,965,519 | A | 6/1976 | Hermann | |
| 4,253,461 | A * | 3/1981 | Strickland et al. | 604/389 |
| 4,338,366 | A | 7/1982 | Evans et al. | |
| 4,645,501 | A * | 2/1987 | Teed | 604/390 |
| 4,840,829 | A | 6/1989 | Suzuki et al. | |
| 5,098,764 | A | 3/1992 | Bassett et al. | |
| 5,100,399 | A * | 3/1992 | Janson et al. | 604/386 |
| 5,244,711 | A | 9/1993 | Drelich et al. | |
| 5,596,787 | A * | 1/1997 | Stevens et al. | 15/220.1 |
| 5,830,555 | A | 11/1998 | Srinivasan et al. | |
| 5,888,006 | A | 3/1999 | Ping et al. | |

(Continued)

FOREIGN PATENT DOCUMENTS

| | | |
|---|---|---|
| GB | 2031039 | 4/1980 |

(Continued)

*Primary Examiner*—Laura C Guidotti
(74) *Attorney, Agent, or Firm*—McCarter & English, LLP

(57) ABSTRACT

A cleaning pad is adapted to be releasably retained on a cleaning implement which includes on its cleaning head either multiple strips of pile-type fastener material or a plurality of attachment structures. The cleaning pad includes a top layer constructed of polyethylene and a bottom layer constructed of rayon. The top and bottom layers are affixed together along their peripheries by a bond line so as to define an enclosed pocket therebetween which is sized and shaped to receive a middle layer constructed of wood pulp paper. Multiple strips of hook-type fastener material are secured on the top layer and are adapted to releasably engage complimentary strips of pile-type fastener material on the cleaning implement. One or more mounting tabs are secured on the bottom layer and are adapted to releasably engage complimentary attachment structures on the cleaning implement. Each mounting tab can be disposed between a retracted, or folded, position and an extended, or unfolded, position.

20 Claims, 5 Drawing Sheets

U.S. PATENT DOCUMENTS

| | | | | |
|---|---|---|---|---|
| 5,960,508 | A | 10/1999 | Holt et al. | |
| 6,003,191 | A | 12/1999 | Sherry et al. | |
| 6,025,050 | A | 2/2000 | Srinivasan et al. | |
| 6,045,622 | A | 4/2000 | Holt et al. | |
| 6,048,123 | A | 4/2000 | Holt et al. | |
| 6,060,149 | A | 5/2000 | Nissing et al. | |
| 6,101,661 | A | 8/2000 | Policicchio et al. | |
| 6,119,298 | A | 9/2000 | Kenmochi | |
| 6,136,146 | A | 10/2000 | Phan et al. | |
| 6,142,750 | A | 11/2000 | Benecke | |
| 6,202,250 | B1 | 3/2001 | Kenmochi et al. | |
| 6,245,413 | B1 | 6/2001 | Kenmochi et al. | |
| 6,280,757 | B1 | 8/2001 | McAtee et al. | |
| 6,305,046 | B1 | 10/2001 | Kingry et al. | |
| 6,319,593 | B1 | 11/2001 | Kenmochi et al. | |
| 6,329,308 | B1 | 12/2001 | Kenmochi et al. | |
| D462,150 | S | 8/2002 | Rader et al. | |
| 6,452,063 | B1 * | 9/2002 | Curro et al. | 604/383 |
| 6,468,931 | B1 | 10/2002 | Reeder et al. | |
| 6,484,346 | B2 | 11/2002 | Kingry et al. | |
| 6,495,151 | B2 | 12/2002 | McAtee et al. | |
| 6,513,184 | B1 | 2/2003 | Brown et al. | |
| 6,669,391 | B2 * | 12/2003 | Policicchio et al. | 401/270 |
| 7,191,486 | B1 * | 3/2007 | Michelson et al. | 15/228 |
| 2002/0016581 | A1 * | 2/2002 | Kline et al. | 604/386 |
| 2002/0026680 | A1 | 3/2002 | Kingry et al. | |
| 2002/0042962 | A1 | 4/2002 | Willman et al. | |
| 2002/0050016 | A1 | 5/2002 | Willman et al. | |
| 2002/0065012 | A1 | 5/2002 | Takabayashi | |
| 2002/0099352 | A1 * | 7/2002 | Heden et al. | 604/387 |
| 2002/0184726 | A1 | 12/2002 | Kingry et al. | |
| 2003/0003831 | A1 | 1/2003 | Childs et al. | |
| 2003/0003832 | A1 | 1/2003 | Childs et al. | |
| 2003/0024062 | A1 | 2/2003 | McKay | |
| 2003/0045197 | A1 | 3/2003 | Kakiuchi | |

FOREIGN PATENT DOCUMENTS

| | | |
|---|---|---|
| JP | 07255630 | 3/1994 |
| JP | 09313416 | 5/1996 |
| JP | 09224895 | 2/1997 |
| JP | 10155713 | 6/1998 |
| JP | 11267079 | 5/1999 |
| JP | 2001104228 | 4/2001 |
| JP | 2001286424 | 10/2001 |
| JP | 2002119452 | 4/2002 |

* cited by examiner

CLEANING PAD

CROSS-REFERENCE TO RELATED APPLICATIONS

This application is a continuation of U.S. patent application Ser. No. 10/639,752, filed Aug. 12, 2003, now U.S. Pat. No. 7,191,486, the contents of which are expressly incorporated by reference in their entirety as part of the present disclosure.

BACKGROUND OF THE INVENTION

The present invention relates generally to cleaning implements and, more particularly, to floor cleaning implements.

Floor cleaning implements are well-known and widely used in commerce to clean hard flooring surfaces, such as ceramic tile, hardwood, vinyl, laminate, linoleum and marble floors.

One type of floor cleaning implement that is well-known and widely used in the art is a dry duster, also commonly referred to in the art as a sweeper. Examples of some well known dry dusters are shown in U.S. Pat. Nos. 6,513,184, 6,484,346, and 6,305,046 and include the.

A dry duster of the type noted above is designed to capture onto a disposable, electrostatically-charged cloth light household debris, such as dust, dirt and hair, from a hard flooring surface. Typically, a dry duster comprises an elongated cylindrical handle which is pivotally coupled to a flat sweeper head through a universal joint. The flat sweeper head is adapted to releasably retain the disposable, electrostatically-charged cloth around its bottom surface. In use, an operator lightly glides the duster over a floor surface in need of cleaning so that the disposable cloth is in direct contact with the floor surface. As the disposable cloth comes into contact with dry household debris present on the floor, such debris is electrostatically retained on the disposable cloth. As can be appreciated, debris collected onto the disposable cloth can simply be disposed of by removing the used disposable cloth from the sweeper head and then discarding the used cloth as waste. In order to perform further cleaning, a new disposable cloth is mounted onto the sweeper head.

Although well-known and widely used in the art, dry dusters of the type described above suffer from a notable drawback. Specifically, dry dusters are designed to electrostatically capture household debris present on a floor but are not designed to wash or scrub a floor. As a result, dry dusters have been found to be inadequate instruments for thoroughly cleaning a hard flooring surface.

Accordingly, dry dusters have been modified in various ways to allow for the wet cleaning of a hard flooring surface.

As an example, it is well known in the art for dry dusters to use a cleaning pad which is moistened with a cleaning solution. In this manner, a pre-moistened cleaning pad can enable a conventional dry duster can be used to wash, or scrub, a hard flooring surface, which is highly desirable.

As another example, it is well known in the art for dry dusters to be equipped with a system for dispensing liquid floor cleaner (this type of duster being referred to herein as a quick clean mop). An example of a quick clean mop is shown in U.S. Pat. No. 5,888,006.

Quick clean mops are similar in construction to dry dusters in that quick clean mops comprise an elongated cylindrical handle which is pivotally coupled to a flat cleaning head through a universal joint. The flat cleaning head of a quick clean mop is adapted to releasably retain a disposable, absorbent cloth (also commonly referred to as a cleaning pad) around its bottom surface.

Quick clean mops differ in construction from dry dusters in that quick clean mops include a floor cleaner dispensing system which is typically actuated through a trigger assembly mounted in close proximity to the free end of the handle. As such, an operator can first dispense a supply of floor cleaner from the quick clean mop onto a desired area of a floor and then rub the absorbent cloth over the dispensed floor cleaner in order to scrub clean the desired area.

As noted briefly above, a quick clean mop is adapted to releasably retain a disposable, absorbent cloth around its flat cleaning head. However, it should be noted that different types of quick clean mops utilize different means for releasably retaining a disposable, absorbent cloth around its flat cleaning head.

One type of quick clean mop which is well-known in the art is provided with one or more attachment structures on the top surface of its flat cleaning head, each attachment structure including a plurality of contiguous, deformable, pie-shaped sections which together define a jagged slot. Examples of this type of quick clean mop include the CLOROX™ READY-MOP™ which is manufactured by the Clorox Company of Oakland, Calif. and the GRAB-IT GO MOP™ which is manufactured by S.C. Johnson & Son, Inc. of Racine, Wis. The cleaning pad designed for use in conjunction with this type of quick clean mop is sized and shaped to include winged portions along its outer periphery which are sized and shaped to be retained within the attachment structures formed on the flat cleaning head of the quick clean mop. Specifically, in use, the cleaning pad is positioned against the bottom surface of its flat cleaning head. In order to retain the cleaning pad in a mounted position against the flat cleaning head, each wing of the cleaning pad is folded onto the top surface of the flat cleaning head and is inserted, by hand, down into the jagged slot defined by each attachment structure, each of the pie shaped sections of the attachment structure engaging the cleaning pad so as to retain the cleaning pad in place on the flat cleaning head.

Another type of quick clean mop which is well-known in the art is provided with one or more strips of a hook-type fastener material (commonly found in conjunction with VELCRO® products) on the bottom surface of its flat cleaning head. An example of this type of quick clean mop is the SWIFFER®WETJET® which is manufactured by Proctor & Gamble of Cincinnati, Ohio. The cleaning pad designed for use in conjunction with this type of quick clean mop similarly includes one or more corresponding strips of pile-type fastener material (commonly found in conjunction with VELCRO® products) on its top surface which are adapted to engage the hook-type fastener material on the cleaning head of the quick clean mop. Specifically, in use, the cleaning pad is positioned against the bottom surface of the flat cleaning head such that the hook-type fastener material is drawn into contact against the pile-type fastener material, thereby securing the cleaning pad onto the cleaning head.

Although well-known and widely used in commerce, the various types of cleaning pads for quick clean mops as described above typically suffer from a notable drawback. Specifically, as noted above, each type of cleaning pad is specifically designed for use in conjunction with a particular quick clean mop. For instance, winged-type cleaning pads are only available for use with quick clean mops which include attachment structures on its top surface. Similarly, cleaning pads with strips of pile-type fastener material are only available for use with quick clean mops which include corresponding strips of hook-type fastener material on the bottom surface of its cleaning head. As a result, most conventional cleaning pads are only adapted for a use with a limited number of quick clean mops, thereby decreasing its range of potential applications, which is highly undesirable.

SUMMARY OF THE INVENTION

It is an object of the present invention to provide a new and improved cleaning pad.

It is another object of the present invention to provide a cleaning pad as described above which can be mounted onto different types of cleaning implements.

It is yet another object of the present invention to provide a cleaning pad as described above which is absorbent and disposable.

It is still another object of the present invention to provide a cleaning pad as described above which has a limited number of parts, is inexpensive to manufacture and which is easy to use.

Accordingly, there is provided a cleaning pad adapted to be releasably retained on a cleaning implement, the cleaning implement comprising a cleaning head and at least one of a fastener material and an attachment structure coupled to the cleaning head, the cleaning pad comprising a fastener material adapted to engage the fastener material on the cleaning implement, and a mounting tab adapted to engage the attachment structure on the cleaning implement.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Figure 1:
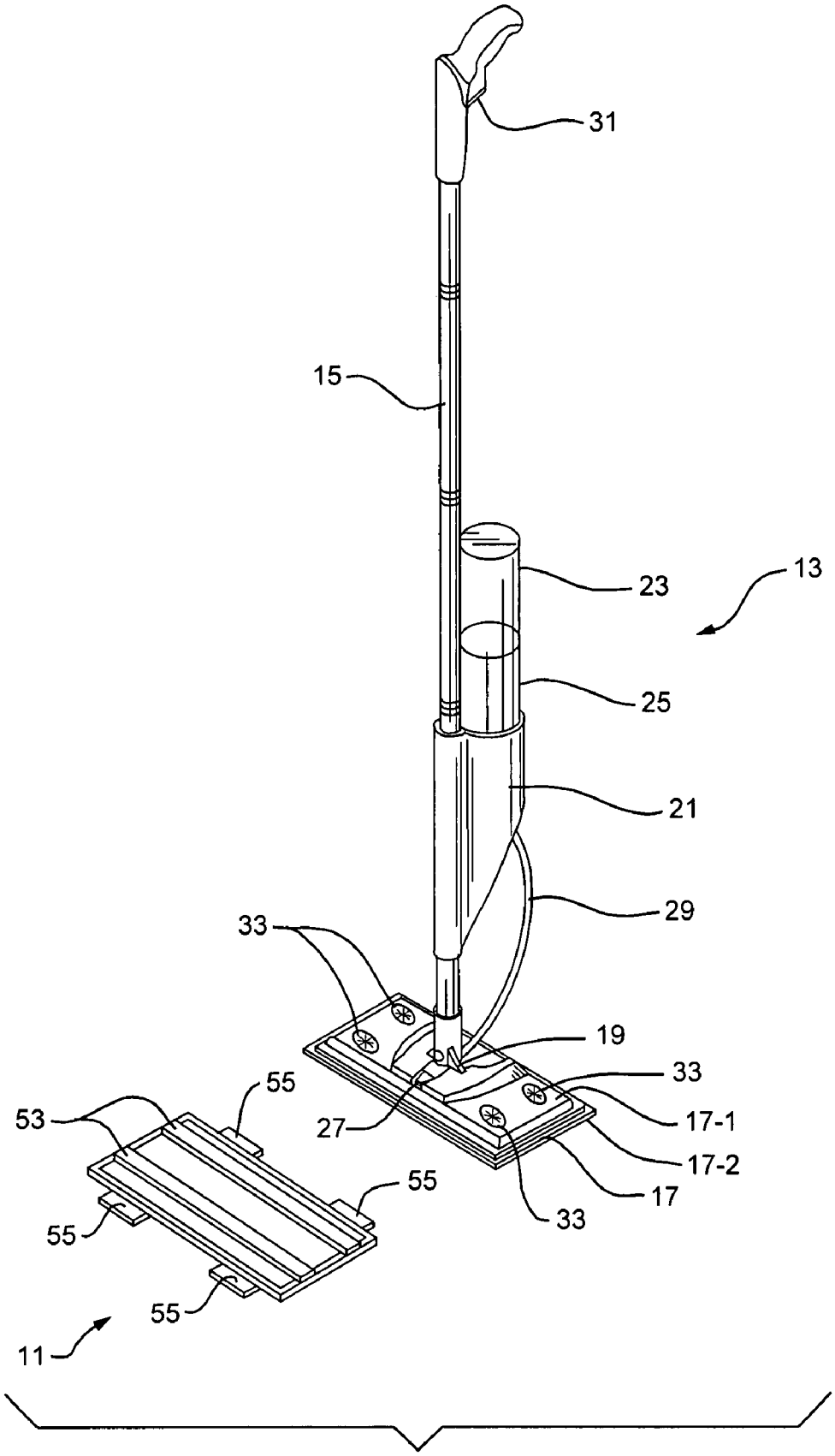
FIG. 1 is a top, front perspective view of a cleaning pad constructed according to the teachings of the present invention, the cleaning pad being shown with a conventional cleaning implement, the pattern of apertures on the tabs of the cleaning pad not being shown.

Referring now to FIG. 1, there is shown a cleaning pad constructed according to the teachings of the present invention, the cleaning pad being identified generally by reference numeral 11. Cleaning pad 11 is shown in conjunction with a cleaning implement 13. As will be described further in detail below, cleaning pad 11 is adapted to be releasably retained onto cleaning implement 13.

Cleaning implement 13 represents any conventional floor cleaning implement which utilizes removable cleaning pads. Cleaning implement 13 is represented herein as being in the form of a conventional quick clean mop which utilizes removable cleaning pads, cleaning implement 13 comprising an elongated, multi-segment, cylindrical handle 15 pivotally coupled to a flat cleaning head 17 through a universal joint 19.

Cleaning implement 13 additionally comprises a retainer 21 for releasably holding a container 23 of cleaning solution 25. A nozzle 27 is shown mounted on cleaning head 17 and is connected to the supply of cleaning solution 25 by an elongated piece of plastic tubing 29. A trigger 31 mounted on handle 15 proximate its free end is coupled to container 23 through a linkage (not shown) and can be used to spray a quantity of cleaning solution 25 out through nozzle 27.

As noted above, cleaning implement 13 represents any conventional floor cleaning implement which utilizes removable cleaning pads. However, it should be noted that conventional floor cleaning implements of this type commonly utilize one of two principal means for retaining a cleaning pad onto its cleaning head.

Figure 5A:
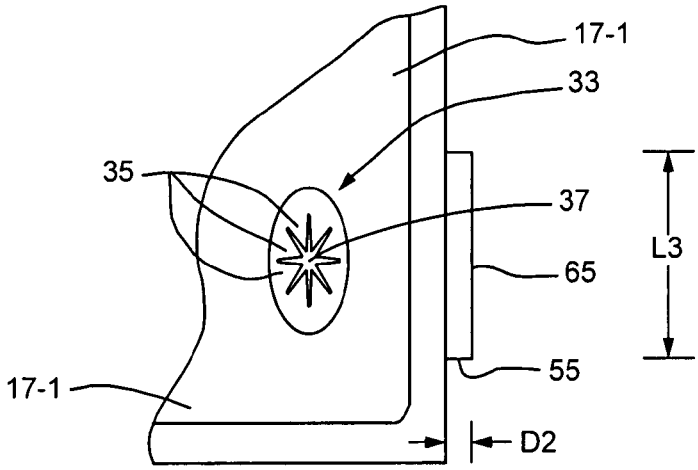
FIGS. 5(*a*)-(*c*) are top perspective fragmentary views of the cleaning pad shown in FIG. 1, the cleaning pad being shown disposed beneath the bottom surface of the sweeper head of a cleaning implement, the cleaning pad being shown at various stages during the attachment of the cleaning pad onto the cleaning implement, the pattern of apertures on the tabs of the cleaning pad not being shown.
Figure 5B:
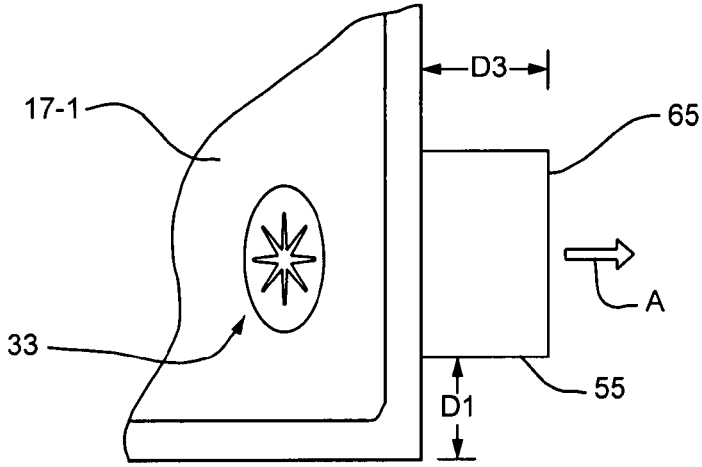
Figure 5C:
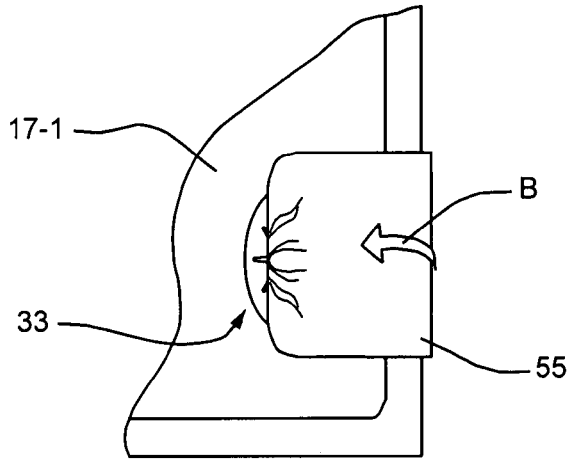

In the first means, which is shown on cleaning implement 13, top surface 17-1 of cleaning head 17 is provided with a plurality of attachment structures 33. As seen most clearly in FIG. 5(*a*), each attachment structure 33 includes a plurality of contiguous, deformable, generally pie-shaped sections 35 which together define a multi-segmented slot 37. Examples of this type of quick clean mop include the CLOROX™ READYMOP™ which is manufactured by the Clorox Company of Oakland, Calif. and the GRAB-IT GO MOP™ which is manufactured by S.C. Johnson & Son, Inc. of Racine, Wis. In use, with a specifically designed cleaning pad disposed against bottom surface 17-2 of cleaning head 17, a portion of the cleaning pad is folded onto top surface 17-1 of cleaning head 17 and is inserted, by hand, down into the slot 37 defined by each attachment structure 33. In this manner, each deformable section 35 of the attachment structure 33 engages the cleaning pad so as to retain the cleaning pad in place on cleaning head 17.

In the second means, which is not shown on cleaning implement 13, one or more strips of a hook-type fastener material (commonly found in conjunction with VELCRO® products) is mounted onto the bottom surface of its cleaning head. An example of this type of quick clean mop is the SWIFFER® WET JET® which is manufactured by Proctor & Gamble of Cincinnati, Ohio. In use, with a specifically designed cleaning pad disposed against the bottom surface of the cleaning head, one or more corresponding strips of pile type fastener material (commonly found in conjunction with VELCRO® products) on the top surface of the specifically designed cleaning pad are adapted to engage the hook-type fastener material on the bottom surface of the cleaning head of the cleaning implement so as to retain the cleaning pad in place on the cleaning implement.

As will be described further in detail below, cleaning pad 11 of the present invention is specifically designed for use with conventional floor cleaning implements which use either of the two aforementioned means for retaining a cleaning pad on its cleaning head. Specifically, cleaning pad 11 is designed for use with a floor cleaning implement which includes one or more attachment structures 33 on the top surface 17-1 of its cleaning head 17. In addition, cleaning pad 11 is designed for use with a floor cleaning implement which includes one or more strips of hook-type fastener material mounted on the bottom surface of its cleaning head. In this capacity, cleaning pad 11 serves as a universal-type cleaning pad which can be used by either type of floor cleaning implement, which is a principal object of the present invention.

Figure 2:
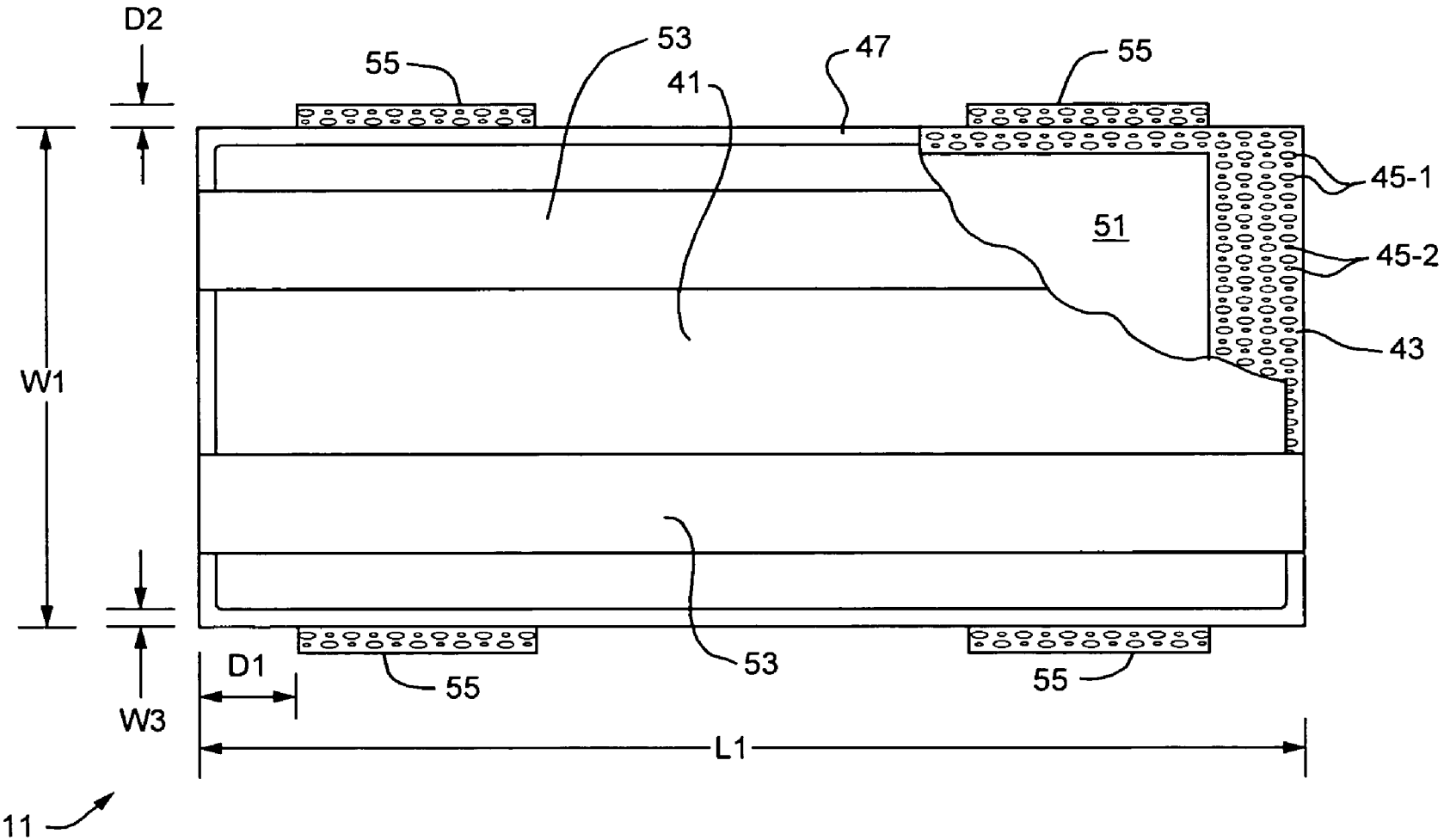
FIG. 2 is a top plan view, broken away in part, of the cleaning pad shown in FIG. 1.
Figure 3:
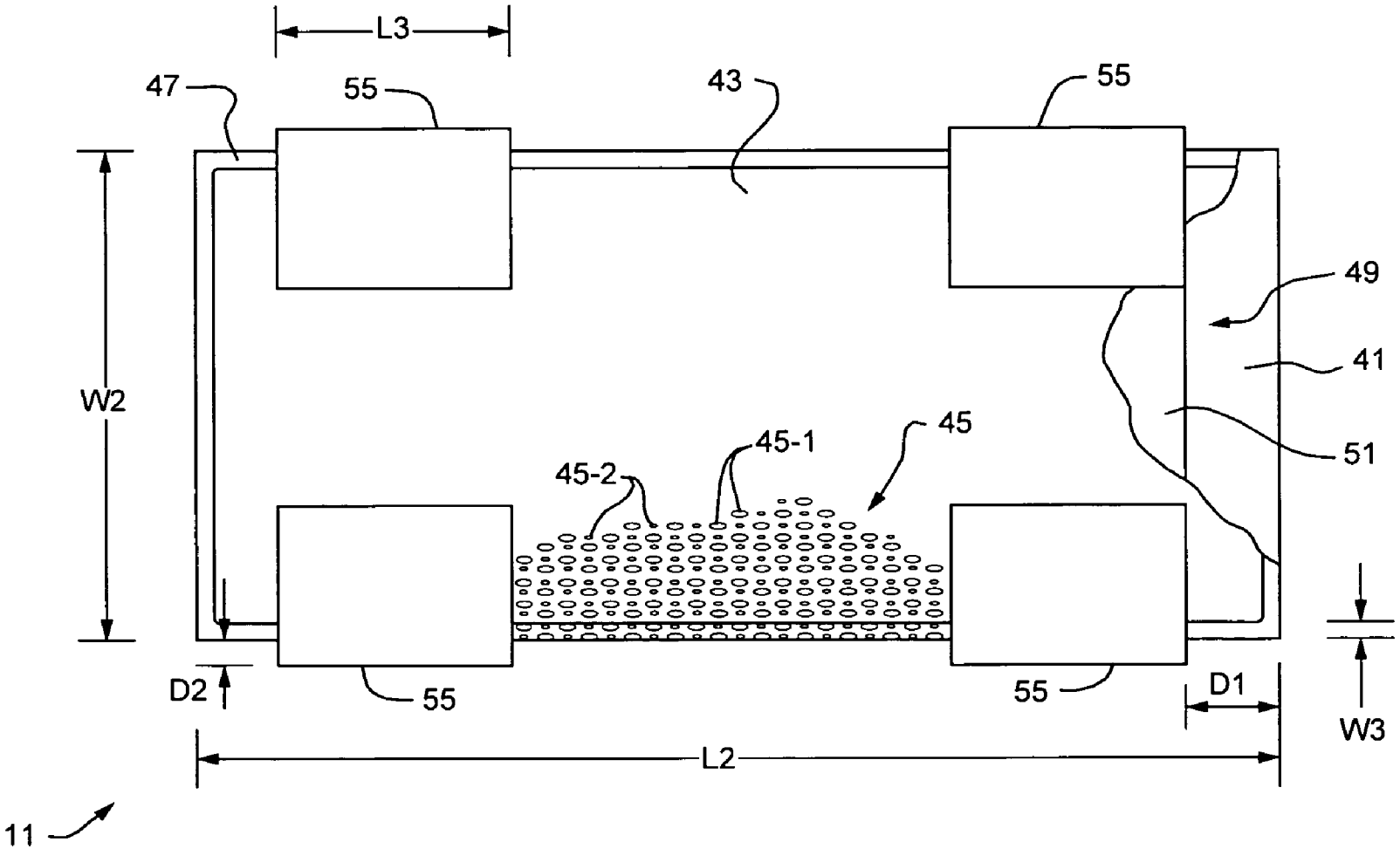
FIG. 3 is a bottom plan view, broken away in part, of the cleaning pad shown in FIG. 1, the pattern of apertures being shown in only a portion of the bottom layer for simplicity purposes only.

Referring now to FIGS. 2 and 3, cleaning pad 11 comprises a top layer 41 and a bottom layer 43 which are affixed together.

Top layer 41 is preferably constructed out of a thin layer of 20 g/m2 polyethylene which is formed into a generally rectangular configuration, top layer 41 having a length L 1 of approximately 29.6 cm and a width W1 of approximately 14.1 cm.

Bottom layer 43 is preferably constructed out of a thin layer of 85 g/m2, 100% rayon which is formed into a generally rectangular configuration, bottom layer 43 having a length L2 of approximately 29.6 cm and a width W2 of approximately 14.1 cm.

As seen most clearly in FIG. 3, bottom layer 43 is provided with a pattern of apertures 45 which extend through the thickness of bottom layer 43, apertures 45 being provided into bottom layer 43 during its forming process. It should be noted that the particular pattern of apertures 45 serves to add greatly to the texture, bulk and absorbency of bottom layer 43, which is highly desirable. For simplicity purposes only, the pattern of apertures 45 is shown on only a portion of bottom layer 43. However, it is to be understood that, in the preferred embodiment, the pattern of apertures 45 extends throughout the entire bottom layer 43.

The pattern of apertures 45 formed into bottom layer 43 includes a plurality of oval shaped apertures 45-1 and a plurality of circular-shaped apertures 45-2. The pattern of apertures 45 are configured into a plurality of parallel, equidistantly-spaced apart vertical columns, each vertical column alternating a single oval-shaped aperture 45-1 with a single circle-shaped aperture 45-2 along its entire length. Preferably, each adjacent column is staggered in such a manner so that horizontal rows are formed, each horizontal row alternating a single oval-shaped aperture 45-1 with a single circle-shaped aperture 45-2 along its entire length.

Top layer 41 and bottom layer 43 have the same approximate shape and size. With top layer 41 stacked in direct alignment on top of bottom layer 43, a bond line 47 is formed along the outer peripheries of top layer 41 and bottom layer 43, bond line 47 having an approximate width W3 in the range between 0.5 cm and 1.0 cm. In this manner, bond line 47 serves to secure together the outer peripheries of top layer 41 and bottom layer 43 in such a manner so as to define an enclosed pocket 49 therebetween.

It should be noted that bond line 47 represents any conventional means for bonding together the outer peripheries of top layer 41 and bottom layer 43. As an example, bond line 47 may represent a uniform continuous layer of an adhesive, a patterned layer of an adhesive or any array of separate lines, spirals or spots of an adhesive. As another example, bond line 47 may represent, inter alia, a heat bond, a pressure bond, an ultrasonic bond, a dynamic mechanical bond or any other suitable bonding means or combinations of these means as are known in the art.

A middle layer 51 is disposed within enclosed pocket 49. Middle layer 51 is preferably constructed out of three sheets of 150 g/m2 wood pulp paper which are formed into a unitary rectangular pad having a length of 25.6 cm and a width of 12.3 cm. As can be appreciated, with middle layer 51 disposed within pocket 49, bond line 47 serves to enclose pocket 49, thereby trapping middle layer 51 between top layer 41 and bottom layer 43.

As noted above, cleaning pad 11 is a universal cleaning pad which is constructed for use with either of the following types of conventional floor cleaning implements: (1) floor cleaning implements which include one or more strips of a hook-type fastener material (commonly found in conjunction with VELCRO® products) mounted onto the bottom surface of its cleaning head (this type of floor cleaning implement being referred to herein simply as a floor cleaning implement with hook-type fastener material); and (2) floor cleaning implements which include one or more attachment structures formed on the top surface of its cleaning head, each attachment structure comprising a plurality of contiguous, deformable, generally pie-shaped sections which together define a multi segmented slot (this type of floor cleaning implement being referred to herein simply as a floor cleaning implement with one or more attachment structures). The particular method in which cleaning pad 11 can be secured onto each of the aforementioned floor cleaning implements will be described in detail below.

As seen most clearly in FIGS. 1 and 2, a pair of mounting strips 53 are secured onto the outer surface of top layer 41. Strips 53 are preferably constructed of a pile-type fastener material (commonly found in conjunction with VELCRO® products). Specifically, strips 53 are preferably constructed of 50 g/m2 polyester.

Strips 53 are secured onto outer surface of top layer 41 in a spaced apart, parallel configuration, strips 53 extending the entire length of top layer 41. Each strip 53 is preferably secured onto top layer 41 using any conventional securement means, such as through the application of a conventional adhesive.

As can be appreciated, strips 53 enable cleaning pad 11 to be releasably retained onto a floor cleaning implement with one or more strips of a hook-type fastener material. Specifically, cleaning pad 11 is first positioned on a flat surface (e.g., a floor) with top layer 41 facing upward. With cleaning pad 11 disposed in this manner, the consumer positions the floor cleaning implement with one or more strips of a hook-type fastener material such that the bottom surface of its cleaning head is drawn into contact against top layer 41 of cleaning pad 11. Positioned as such, the one or more strips of hook-type fastener material located on the bottom surface of the cleaning head of the floor cleaning implement are drawn into contact with corresponding mounting strips 53 on cleaning pad 11, thereby securing cleaning pad 11 onto the floor cleaning implement. It should be noted that, in order to remove cleaning pad 11 from the floor cleaning implement, the consumer is required to pull cleaning pad 11 away from the floor cleaning implement with a withdrawal force greater than the engagement force between mounting strips 53 and the hook-type fastener material located on the bottom surface of the cleaning head of the floor cleaning implement.

As seen clearly in the drawings, a plurality of mounting tabs 55 are secured onto the outer surface of bottom layer 43. Tabs 55 are preferably constructed out of the same material as bottom layer 43 (i.e., a thin layer of 85 g/m2, 100% rayon).

Tabs 55 are disposed on outer surface of bottom layer 43, each tab 55 being located in close proximity to a corresponding corner of bottom layer 43.

Each tab 55 is generally rectangular in configuration and has a length L3 of approximately 6.0 cm. Each tab 55 is also spaced in from an associated corner of bottom layer 43 a distance 01 of approximately 2.6 cm. As will be described further in detail below, each tab 55 can be disposed between a retracted position, as shown in FIG. 4(*a*), and an extended position, as shown in FIG. 4(*b*).

Figure 4A:
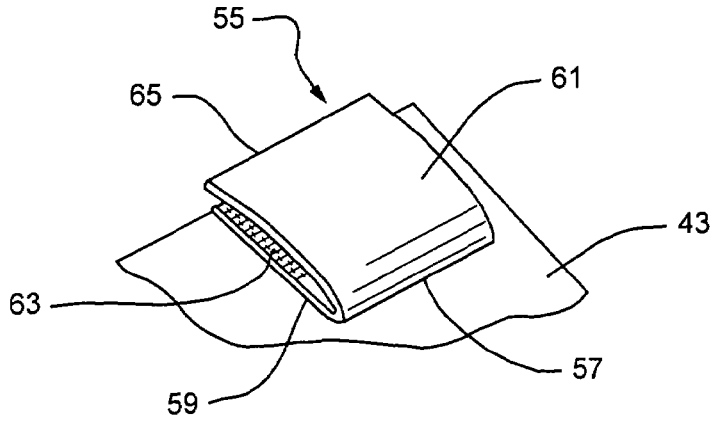
FIGS. 4(*a*)-(*c*) are bottom perspective fragmentary views of the cleaning pad shown in FIG. 1, the cleaning pad being shown at various stages during the attachment of the cleaning pad onto a cleaning implement; the pattern of apertures on the tabs and bottom layer of the cleaning pad not being shown.
Figure 4B:
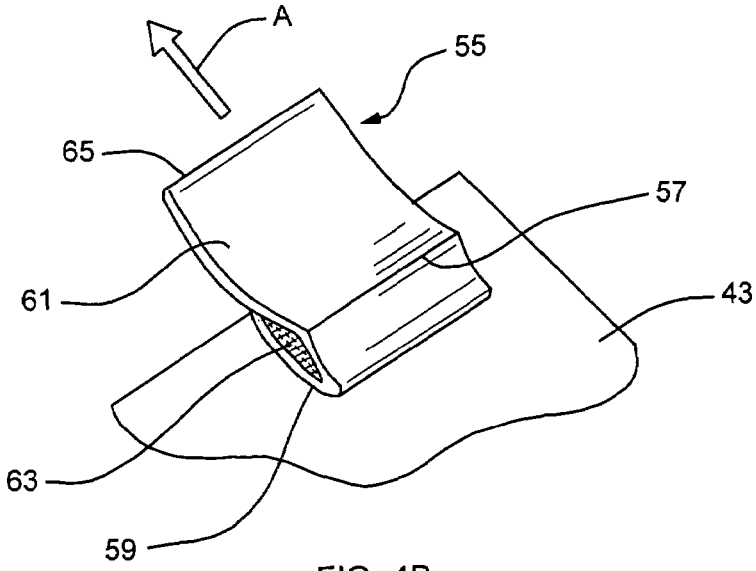
Figure 4C:
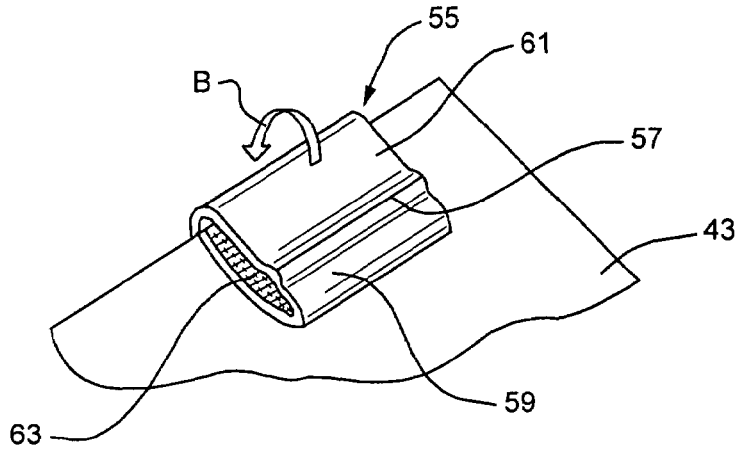

As seen most clearly in FIG. 4(*a*), each tab 55 is folded about a fold line 57 so as to define a lower flap 59 and an upper flap 61. A portion of lower flap 59 is secured onto bottom layer 43 by a strip of an adhesive 63. Upper flap 61 is disposed directly above lower flap 59, the free end 65 of upper flap 61 extending out from the outer periphery of bottom layer 43 a distance 02 of approximately 0.6 cm when disposed in its retracted position.

It should be noted that, while in their retracted positions, tabs 55 extend a relatively short distance out from the outer periphery of bottom layer 43 so as not to interfere when cleaning pad 11 is used in conjunction with a cleaning implement which includes one or more strips of a hook-type fastener material, which is highly desirable. It should also be noted that, the relatively short length L3 of tabs 55 serves to preclude tabs 55 from interfering with the dispensing of cleaning solution from particular models of cleaning implements, which is highly desirable.

Due to the pattern of apertures 45 formed into tabs 55, a relatively small amount of the strip of adhesive 63 penetrates through lower flap 59 and contacts upper flap 61, thereby securing a portion of upper flap 61 to a portion of lower flap 59, as shown in FIG. 4(*a*). With a portion of upper flap 61 secured to a portion of lower flap in the manner noted above, tab 55 is in its originally-configured, retracted (i.e., folded) position.

It should be noted that the strength of the adhesive bond between lower flap 59 and bottom layer 43 is significantly greater than the adhesive bond between upper flap 61 and lower flap 59. As will be described further below, the difference in the strengths of the adhesive bonds enables the user to separate upper flap 61 from lower flap 59 without compromising the adhesive bond between lower flap 59 and bottom layer 43, the separation of upper flap 61 from lower flap 59 being accomplished through the application of a minimal withdrawal (i.e., pulling) force onto free end 65.

As can be appreciated, mounting tabs 55 enable cleaning pad 11 to be releasably retained onto a floor cleaning implement with one or more attachment structures, such as floor cleaning implement 13. Specifically, cleaning pad 11 is first positioned on a flat surface (e.g., a floor) with top layer 41 facing upward. With cleaning pad 11 disposed in this manner, the consumer positions floor cleaning implement 13 such that bottom surface 17-2 of cleaning head 17 is drawn into contact against mounting strips 53 of cleaning pad.

It should be noted that cleaning pad 11 is originally configured with its mounting tabs 55 disposed in their retracted (i.e., folded) position, as shown in FIGS. 4(*a*) and 5(*a*). With mounting tabs 55 disposed in their retracted position, free end 65 of each tab 55 extends past the outer periphery of bottom layer 43 a distance D2 of approximately O.6 cm. In order to secure cleaning pad 11 onto cleaning head 17 of cleaning implement 13, the user is required to pull free end 65 of each tab 55 laterally out and away from the outer periphery of bottom layer 43, as shown in FIGS. 4(*b*) and 5(*b*). Pulling free end 65 laterally outward in the direction represented by arrow A in FIGS. 4(*b*) and 5(*b*) causes the weak adhesive bond between upper flap 61 and lower flap 59 to be broken, thereby enabling upper flap 61 and the portion of lower flap 59 which is not adhered to bottom layer 43 to be outwardly extended. With free end 65 pulled out as far as it can go, each tab 55 is the to be in its extended (Le., unfolded) position. It should be noted that, with each tab 55 disposed into its extended position, upper flap 61 extends out past the outer periphery of bottom layer 43 a distance 03 of approximately 4.5 cm, as seen most clearly in FIG. 5(*b*).

With each tab 55 pulled laterally out and into its extended position, as shown in FIGS. 4(*b*) and 5(*b*), each tab 55 is then wrapped around cleaning head 17 such that its free end 65 is drawn towards an associated attachment structure 33. Specifically, to secure cleaning pad 11 onto cleaning head 17, each tab 55 is wrapped around cleaning head 17 in the direction represented by arrow B in FIGS. 4(*c*) and 5(*c*). The free end 65 of each tab 55 is then pushed (Le., tucked) into the slot 37 defined by a corresponding attachment structure 33. As can be appreciated, with the free end 65 of each tab 55 tucked into an associated attachment structure 33, the generally pie-shaped sections 35 of attachment structure 33 engage the material of tab 55, thereby retaining cleaning pad 11 in place on cleaning head 17. It should be noted that, in order to remove cleaning pad 11 from cleaning head 17, cleaning pad 11 is pulled away from cleaning head 17 with a force greater than the cumulative engagement force between attachment structures 33 and tabs The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A cleaning pad adapted to be releasably retained on a cleaning implement, the cleaning implement comprising a cleaning head including at least one of a first fastener material affixed to a first surface of the cleaning head and a plurality of attachment structures coupled to a second surface of the cleaning head opposite the first surface, the cleaning pad comprising:

a body defining a longitudinal axis;

at least four mounting tabs, each adapted to engage a respective one of the attachment structures on the cleaning head to releasably retain the cleaning pad to the cleaning head, wherein each mounting tab defines a lower flap, a portion of which is secured to the body of the cleaning pad, and an upper flap movable between a retracted position and an extended position, wherein in the retracted position, a portion of the upper flap is releasably secured to a portion of the lower flap and, in the extended position, a portion of the upper flap is releasably retained by the attachment structures; and at least two laterally spaced elongated strips of a second fastener material adapted to engage the first fastener material to releasably retain the cleaning pad to the cleaning head, wherein the at least two elongated strips extend longitudinally substantially in the direction of the longitudinal axis of the body of the cleaning pad and are affixed to a surface of the body of the cleaning pad and not affixed to the mounting tab.

2. The cleaning pad according to claim 1, wherein the body further comprises:

(a) a top layer; and (b) a bottom layer coupled to the top layer.

3. The cleaning pad according to claim 2, wherein the body further comprises a middle layer disposed between the top layer and the bottom layer.

4. The cleaning pad according to claim 3 wherein the top layer is affixed to the bottom layer so as to define a pocket therebetween, and the middle layer is disposed within the pocket.

5. The cleaning pad according to claim 3 wherein the middle layer is manufactured out of three sheets of wood pulp paper.

6. The cleaning pad according to claim 2 wherein the top layer is manufactured out of polyethylene.

7. The cleaning pad according to claim 2 wherein the bottom layer is manufactured out of rayon.

8. The cleaning pad according to claim 2 wherein the bottom layer is provided with a pattern of apertures.

9. The cleaning pad according to claim 8 wherein the pattern of apertures extends through the thickness of the bottom layer.

10. The cleaning pad according to claim 9 wherein the pattern of apertures are configured into (i) a plurality of parallel, equidistantly-spaced apart vertical columns, each vertical column alternating a single oval-shaped aperture with a single circular-shaped aperture along its entire length, (ii) a plurality of parallel, equidistantly-spaced apart horizontal rows, each horizontal row alternating a single oval-shaped aperture with a single circular-shaped aperture along its entire length, or (iii) any combination thereof.

11. The cleaning pad according to claim 2 wherein the second fastener material is formed into one or more strips which are secured onto the outer surface of the top layer.

12. The cleaning pad according to claim 11 wherein the second fastener material is constructed out of pile-type fastener material.

13. The cleaning pad according to claim 11 wherein the second fastener material is constructed out of polyester.

14. The cleaning pad according to claim 2 wherein the mounting tab is secured onto the outer surface of the bottom layer.

15. The cleaning pad according to claim 2 wherein the upper flap includes a free end which extends out from the outer periphery of the bottom layer a distance of approximately 0.6 cm when the upper flap is in its retracted position.

16. The cleaning pad according to claim 2 wherein the mounting tab is manufactured out of rayon.

17. The cleaning pad according to claim 1 wherein a portion of the lower flap is secured onto the cleaning pad by an adhesive and an adhesive secures the upper flap to the lower flap, the strength of the adhesive bond between the lower flap and the cleaning pad being greater than the adhesive bond between the upper flap and the lower flap.

18. A cleaning pad adapted to be releasably retained on a cleaning implement, the cleaning implement comprising a substantially rectangular cleaning head and at least one of a first fastener material and at least two attachment structures coupled to the cleaning head, the cleaning pad comprising:

a substantially rectangular body defining a longitudinal axis and including a top layer and a bottom layer coupled to the top layer;

at least two laterally spaced elongated strips of a second fastener material adapted to engage the first fastener material on the cleaning head, wherein the at least two strips at least one of (i) are parallel to the longitudinal axis of the body of the cleaning pad and (ii) extend longitudinally substantially in the direction of the longitudinal axis of the body of the cleaning pad; and at least two opposing mounting tabs secured onto opposing sides of the outer surface of the bottom layer, wherein each tab is adapted to engage a respective one of the attachment structures on the cleaning implement and defines a lower flap, a portion of which is secured onto the bottom layer of the cleaning pad by an adhesive, and an upper flap movable between a retracted position and an extended position, wherein a portion of the upper flap is releasably secured to a portion of the lower flap in the retracted position by an adhesive, a portion of the upper flap is releasably retained by the attachment structure in the extended position, and the strength of the adhesive bond between the lower flap and the bottom layer is greater than the strength of the adhesive bond between the upper flap and the lower flap.

19. A cleaning pad adapted to be releasably retained on a cleaning implement, the cleaning implement comprising a cleaning head and at least one of a first fastener material affixed to a surface of the cleaning head and a plurality of attachment structures coupled to the cleaning head, the attachment structures defining an aperture or slot having a plurality of retaining sections therein, the cleaning pad comprising:

a body defining a longitudinal axis and comprising at least two layers including a top layer and a bottom layer;

at least four mounting tabs secured to the bottom layer, wherein each tab is adapted to engage the aperature or slot of a respective one of the attachment structures on the cleaning head and defines a lower flap, a portion of which is secured to the body of the cleaning pad, and an upper flap movable between a retracted position and an extended position, wherein in the retracted position, a portion of the upper flap is releasably secured to a portion of the lower flap and, in the extended position, a portion of the upper flap is releasably retained within the aperture or slot of the attachment structure through engagement with the retaining sections; and a least two laterally spaced elongated strips of a second fastener material secured to the top layer and adapted to engage the first fastener material on the cleaning head to secure the cleaning pad to the cleaning head, wherein the at least two elongated strips extend longitudinally substantially in the direction of the longitudinal axis of the body of the cleaning pad and avoid contact with the mounting tab.

20. A cleaning pad adapted to be releasably retained on a cleaning implement, the cleaning implement comprising a cleaning head and at least one of a first fastener material thereon and a plurality of attachment structures coupled to the cleaning head, the cleaning pad comprising:

a body defining a longitudinal axis and comprising at least two layers including a top layer and a bottom layer;

at least two laterally spaced elongated strips of a second fastener material secured to the outer surface of the top layer and adapted to engage the first fastener material on the cleaning head, wherein the at least two elongated strips extend longitudinally substantially in the direction of the longitudinal axis of the body of the cleaning pad; and at least four mounting tabs, each adapted to engage a respective one of the attachment structures on the cleaning implement;

wherein each mounting tab (i) can be disposed between a retracted position and an extended position, (ii) tab is folded about a fold line so as to define a lower flap and an upper flap and (iii) is secured onto the outer surface of the bottom layer, and an adhesive secures a portion of the lower flap onto the bottom layer and secures a portion of the upper flap onto a portion of the lower flap, the strength of the adhesive bond between the lower flap and the bottom layer being greater than the adhesive bond between the upper flap and the lower flap.

* * * * *